United States Patent [19]

Boyack

[11] 4,409,772

[45] Oct. 18, 1983

[54] METHOD OF LINING CONCRETE IN-GROUND SWIMMING POOL

[76] Inventor: John D. Boyack, 101 Gillette Rd., Spencerport, N.Y. 14559

[21] Appl. No.: 301,956

[22] Filed: Sep. 14, 1981

[51] Int. Cl.[3] ..... E04B 1/00

[52] U.S. Cl. ..... 52/746; 52/169.7; 52/743; 156/71

[58] Field of Search ..... 52/743, 746, 169.7; 156/71

[56] References Cited

U.S. PATENT DOCUMENTS

| | | | |
|---|---|---|---|
| 4,004,386 | 1/1977 | Diffenderfer | 52/169.7 X |
| 4,106,246 | 8/1978 | LaFountaine | 52/169.7 |
| 4,203,170 | 5/1980 | Lankheet | 52/169.7 X |
| 4,207,017 | 6/1980 | Jarrell | 52/169.7 X |
| 4,263,759 | 4/1981 | Miller | 52/169.7 |

FOREIGN PATENT DOCUMENTS

| | | | |
|---|---|---|---|
| 38641 | 3/1979 | Japan | 52/169.7 |
| 657156 | 4/1979 | U.S.S.R. | 52/169.7 |

*Primary Examiner*—Carl D. Friedman
*Attorney, Agent, or Firm*—Stonebraker, Shepard & Stephens

[57] ABSTRACT

A concrete in-ground swimming pool is given a resin bonded glass fiber liner that is securely bonded to the upper rim of the concrete pool wall 10 just below the coping 11. This is done with two saw cuts 15 and 16 inclined to each other to diverge with increasing depth of about ¾" into the concrete wall below the coping so that material between the saw cuts can be cleaned out to form a dovetail shaped recess 17. A mixture of polyester resin and glass fibers fills the dovetail recess and covers over the upper pool wall and a narrow band around the upper rim of the pool in the region of the dovetail to form a bonding surface 21 locked to the recess. This is sanded smooth after the resin sets, and then the pool is lined with glass fiber mats 25 coated with polyester resin 26 that bonds to the bonding surface to form a waterproof liner bonded to the upper rim of the pool and supported by the concrete that serves as a mold.

5 Claims, 6 Drawing Figures

METHOD OF LINING CONCRETE IN-GROUND SWIMMING POOL

BACKGROUND

Concrete in-ground swimming pools deteriorate with age, acquire cracks and crumbles, develop leaks, and require repairs. Also, repairs to concrete pools can be expensive and fairly short lived.

I have discovered a simple, inexpensive, and effective way of lining concrete in-ground swimming pools with a waterproof liner that is reliable and long lived. My liner improves the quality and surface finish of an in-ground concrete pool, makes it watertight and leak-proof, serves many years of use, and outlasts the typical repair of such a pool.

SUMMARY

I use a concrete in-ground swimming pool as a mold for forming a liner of resin bonded glass fibers making a smooth surfaced and watertight shell within the preexisting concrete pool. The concrete then supports and protects the resin bonded glass fiber lining that is strong, wear-resistant, watertight, and able to yield with small movements of the concrete caused by any shifting of the ground. An important part of my liner is a secure bond between the liner and the upper rim of the pool, and I have devised a simple and effective way for accomplishing such a bond.

I make a first saw cut about ¾" deep into the concrete around the upper rim of the pool just below the coping and then make a second saw cut about ¾" deep in the concrete following the first saw cut but inclined relative to the first saw cut so that the first and second cuts diverge with increasing depth into the concrete. By cleaning out between the two cuts I form a dovetail shaped recess in the concrete wall. I then apply a mixture of polyester resin and glass fibers to fill the dovetail recess and cover over a narrow band of the concrete around the upper rim of the pool over and adjacent the dovetail recess to form a bonding surface locked to the recess. I sand the bonding surface smooth after the polyester resin sets and then line the pool with glass fiber mats coated, impregnated, and bonded with polyester resin that bonds to the bonding surface to reliably support the liner around the upper rim of the pool.

DRAWINGS

FIGS. 1 through 6 are fragmentary cross-sectional views of a concrete pool wall showing preferred successive steps for lining the pool according to my invention.

DETAILED DESCRIPTION

Figure 1:
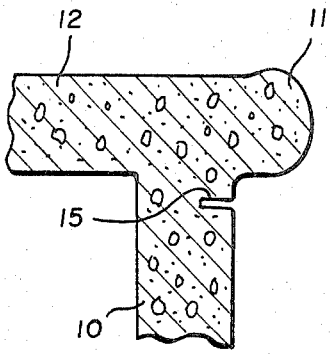

The fragment of concrete pool wall 10 illustrated in the drawings is taken around the upper rim of a pool around coping 11 and deck 12 to show a typical concrete in-ground pool that can be lined according to my invention. Others have used resin bonded glass fiber liners in various pool constructions, but these have not been successful for lining concrete pools, partly because of the difficulty of attaching the liner to the pool. I have solved this problem with the illustrated method described below.

The first step as shown in FIG. 1 is to make a first saw cut 15 extending about ¾" into concrete wall 10 around the upper rim of the pool and preferably just below the coping bull nose 11. I prefer a portable circular saw with a masonry cutting blade set perpendicular to the saw base for making cut 15, and I run such a circular saw evenly around the entire upper rim of the pool with the base of the saw guiding against the underside of bullnose 11 so that cut 15 extends uniformly around the pool wall. The cut can also be made lower, if preferred.

Figure 2:
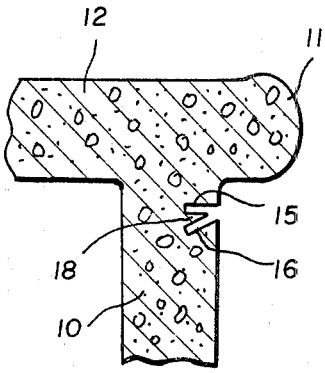
Figure 3:
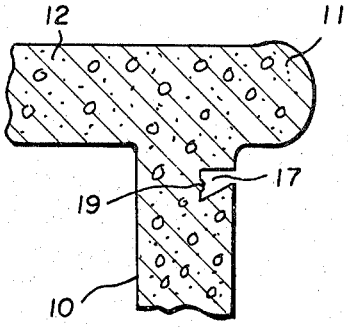
Figure 4:
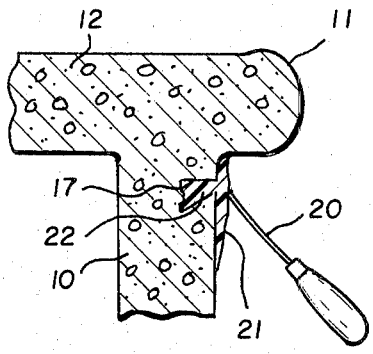

Then I angle the blade of the circular saw a few degrees and make a second saw cut 16 following the first cut 15 and also extending about ¾" deep into concrete wall 10. Second cut 16 is preferably angled downward relative to first cut 15 as illustrated in FIG. 2 so that the first and second cuts diverge with increasing depth into concrete wall 10. Cuts 15 and 16 then form opposite surfaces for a dovetail shaped recess 17 that I form by cleaning out a concrete ridge 18 between cuts 15 and 16. Much of ridge 18 breaks away during the sawing of cuts 15 and 16, and any remaining ridge 18 is quickly and easily removed from dovetail recess 17 with a hammer and chisel. The bottom or wide end 19 of dovetail recess 17 need not be smooth and flat, and this is illustrated by slight irregularity at recess bottom 19.

Then with a putty knife 20 or similar trowelling or knifing tool I fill recess 17 with a mixture of polyester resin and glass fibers. Such mixtures are commercially available in several forms that have a thick consistency and set to form a resin matrix carrying reinforcing glass fibers. I press this mixture into dovetail recess 17 and butter it as evenly as possible over recess 17 and the adjacent inner surfaces of pool wall 10 over and around recess 17 under coping 11. This forms a bonding surface 21 as a narrow band around the upper rim of pool wall 10 integrally joined to a key 22 extending into dovetail recess 17 to lock bonding surface 21 to the upper rim of concrete wall 10.

Figure 5:
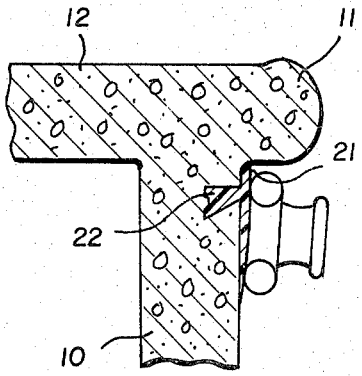
Figure 6:
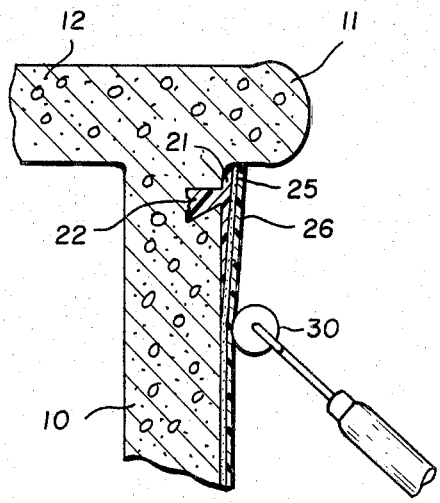

Bonding surface 21 is unavoidably uneven after being manually trowelled or knifed in place, so after it sets I sand it sooth with a disk or belt sander as schematically illustrated in FIG. 5. This leaves bonding surface 21 smooth and even and securely locked to wall 10 where it provides a bonding surface for a linear covering the rest of the pool interior.

I apply the liner by positioning glass fiber mats 25 against the inside of pool wall 10 to overlie bonding surface 21, and I coat mats 25 with a layer of polyester resin 26 that covers and impregnates mats 25, extends through mats 25, and bonds securely to bonding surface 21. Mats 25 are conventional glass fiber mats available for other resin bonded glass fiber structures, and resin 26 is also one of the conventional resins used for bonding glass fibers in forming structures conforming to a mold. Several different polyester and epoxy resins are available for this and are suitably durable and wear-resistant in a pool environment. The resin 26 used for bonding the glass fiber mats must form a secure bond with the resin used for bonding surface 21 so that the upper rim of the liner is securely attached to the pool wall.

To give resin 26 a smooth and usable surface without further treatment I use a conventional paint roller 30 to roll resin 26 smoothly and evenly over glass fiber mats 25. Paint rollers are cheap enough to be thrown away after use on a swimming pool liner job, and they are effective and quick at rolling resin 26 smoothly into place to give the liner a smooth and even surface that is easy to keep clean and easy on swimmers' skin.

Pool wall 10 serves as a concrete mold for receiving and supporting mats 25 and resin 26 that form a resin bonded glass fiber shell within the pool. Locked bonding surface 21 securely bonds the upper rim of the liner to the pool, and otherwise, the liner rests against, but is not attached to, the pre-existing concrete. This allows the liner to yield and accommodate to slight motions of concrete caused by shifting ground.

Glass fiber mats and bonding resin 26 can be formed over steps, and around skimmers, lights, drains, openings, ladders, and other pool accessories. Resin bonded glass fiber liners withstand water and weather and remain watertight for years. They are also more easily repaired than concrete walls and can significantly reduce maintenance expense for concrete pools.

I claim:

1. A method of lining a concrete, in-ground swimming pool, said method comprising:

a. making a first saw cut about ¾ inches deep in said concrete around the upper rim of said pool below the coping for said pool;

b. making a second saw cut about ¾ inches deep in said concrete following said first saw cut but inclined relative to said first saw cut so said first and second cuts diverge with increasing depth into said concrete;

c. cleaning out a dovetail shaped recess formed in said concrete by said first and second saw cuts;

d. applying a mixture of polyester resin and glass fibers to fill said dovetail recess and cover over a narrow band of said concrete around said upper rim of said pool in the region of said dovetail recess to form a bonding surface locked to said recess;

e. sanding said bonding surface smooth after said polyester resin sets; and f. lining said pool with glass fiber mats coated with polyester resin bonded to said bonding surface to form a waterproof liner supported by said concrete serving as a mold.

2. The method of claim 1 including using paint rollers for applying said polyester resin to said glass fiber mats and forming said liner with a smooth inner surface.

3. The method of claim 1 including making said first saw cut uniformly level and closely below a bull nose of said coping.

4. The method of claim 3 including inclining said second saw cut downward relative to said first saw cut.

5. The method of claim 4 including using paint rollers for applying said polyester resin to said glass fiber mats and forming said liner with a smooth inner surface.

* * * * *